United States Patent [19]

Martin

[11] Patent Number: 4,805,890

[45] Date of Patent: Feb. 21, 1989

[54] SHEET STACKING MACHINE

[76] Inventor: Merrill D. Martin, 5405 Bacon Rd., Oakland, Calif. 94619

[21] Appl. No.: 82,280

[22] Filed: Aug. 6, 1987

[51] Int. Cl.[4] ..... B65H 29/68

[52] U.S. Cl. ..... 271/203; 271/214; 271/216; 271/217; 414/789.9; 414/793.1; 414/794.4; 414/926

[58] Field of Search ..... 271/69, 202, 203, 214, 271/215, 216, 217, 220, 223, 224; 414/35, 36, 43, 45, 48, 49, 100

[56] References Cited

U.S. PATENT DOCUMENTS

| | | | |
|---|---|---|---|
| 3,191,927 | 6/1965 | Hartbauer et al. | 414/36 X |
| 3,580,402 | 5/1971 | Tolf | 414/36 |
| 3,759,402 | 9/1973 | Hitch | 271/217 |
| 3,892,168 | 7/1975 | Grobman | 271/218 |
| 3,905,595 | 9/1975 | Adams | 271/217 |
| 4,040,618 | 8/1977 | Vermes | 271/182 |
| 4,111,411 | 9/1978 | Graves | 271/199 |
| 4,188,861 | 2/1980 | Kroeze et al. | 271/203 X |
| 4,200,276 | 4/1980 | Marsche | 271/202 X |

*Primary Examiner*—Joseph J. Rolla
*Assistant Examiner*—David H. Bollinger
*Attorney, Agent, or Firm*—Alfons Puishes

[57] ABSTRACT

A machine for handling flat sheets employs a pair of conveyors in series to receive the sheets from a processing machine and to deliver them to a downwardly moving platform to form a stack thereon and to deliver the stack so formed. Both conveyors operate at a predetermined initial speed to deliver to the platform until a predetermined number of sheets is received from the processing machine. At that point both conveyors are speeded up for a short interval to clear the first conveyor and then the first conveyors is tilted upwards and slowed down which stops the flow to the second conveyor and accumulates the sheets on the first conveyor. The second conveyor continues at a high speed to complete the stack on the platform. The sheets are then discharged from the platform. The first conveyor is returned to its original angle of tilt and both conveyors are returned to their original speeds and the platform returns to its original height to start forming a new stack.

5 Claims, 13 Drawing Sheets

19
18
15
11
17
17
14
13A
5
12
22
21
26
27
23

SHEET STACKING MACHINE

FIELD AND BACKGROUND OF THE INVENTION

In the boxboard industry it is necessary to effect the rapid handling of sheets of corrugated board or fiberboard after they have been cut off by a knife in the previous step of the manufacture, usually a corrugator, and deliver them rapidly to form a stack for further handling or shipping. Numerous machines have been,-constructed for this purpose, all of which have certain features in common. Namely, these consist of conveying the sheets from the cut-off knife of the previous operation on an upwardly inclining conveyor to an elevator platform and depositing them thereon. The platform is then timed to descend gradually as the sheets pile up from the conveyor and when a certain predetermined height of sheets is reached, stopping he flow of sheets to the elevator and discharging the stack for further processing or shipment, then returning the elevator to its upper height limit and repeating the cycle for the next batch.

In the course of movement of the sheets it is necessary to cause them to overlap or effect what is known in the trade as "shingling" in order to help in forming the sheets into a pile. This shingling may be effected by varying the speeds of intermittent conveyors arranged in linear aspect to each other and by the use of various stops and gripping mechanisms to hold the sheets in position.

Since the sheets are inherently flimsy in nature it is difficult to maintain their proper alignment for conveying and stacking and they are consequently given to running askew, causing entanglement and jamming of the conveyor line and otherwise interrupting the operation.

The best_known prior art known to the applicant which has been developed to solve some of these problems is covered by the patents listed below.

U.S. Pat. No. 3,892,168 to Grobman discloses and claims an elevator disposed to receive sheets in the form of a stack from a horizontal conveyor, the elevator being designed to lower to a hydraulic actuated parallelogram mechanism as the sheets accumulate. When the stack has reached a predetermined height, stop fingers operate to stop the flow of sheets to the elevator while suitably positioned pusher mechanism transfers the stack to further conveyors. No provision is made for the shingling of the sheets during the handling process. It utilizes a parallelogram mechanism to lower the stack and mechanical pusher to remove same from elevator. No special sheet handling on conveyors are provided.

U.S. Pat. No. 3,905,595 to Adams discloses a more or less conventional inclined conveyor operating at a speed slower than the rate of discharge of the sheets from the preceding operation in order to effect the shingling along their lengths. The sheets are discharged to an elevator designed to lower as the stack accumulates with provisions consisting of mechanical stops to interrupt the flow of sheets while the stack is being discharged from the elevator at its predetermined height after which it is again returned. The claimed novelty lies in the method of driving the elevator which consists of hydraulically operated chain drives at opposite corners of the platform with leveling means for the elevator platform, the base of which consists of chain driven rollers. The claimed novel leveling means comprises two tortion bars at opposite ends of the elevator platform driven by chains corresponding to vertical movement of the platform. No novel sheet handling means are disclosed or claimed.

U.S. Pat. No. 4,040,618 to Vermes utilizes a long inclined conveyor operating at a slow speed on which the shingling is effected. This conveyor discharges to a second conveyor operating at a higher speed which discharges the shingled sheets to the elevator. The latter is likewise constructed to lower as the sheets accumulate and discharge when the pile is completed. Operation depends on controlling the rate of speeds of the long shingling conveyor with the short transfer conveyor whereby the speed of the shingling conveyor is decreased while the speed of the transfer conveyor is increased while the flow of sheets from the shingling conveyor to the transfer conveyor is arrested when the stack is being discharged from the elevator. The controlled speed transfer conveyor and quadruple set of mechanical or positive stops are required and are conducive to skewing and jamming of the sheets enroute to the elevator.

U.S. Pat. No. 4,200,276 to Marschke. In this system the sheets are received from the knife of a corrugator or other previous processing machine by high speed conveyor which feeds them into a slower speed or shingling conveyor which is vacuum assisted to receive a predetermined amount of shingling. They are then fed into an intermediate or accumulating conveyor on which they are permitted to accumulate or pile up as it were before discharging the final long incline conveyor which feeds to the stack forming elevator. Normally this conveyor operates at the same speed as the accumulating conveyor except when the stack is nearing its top or completion state when this conveyor is speeded up and discharges the remaining counted sheets onto the stack, leaving the trailing sheets on the accumulating conveyor until a control discharges the stack from the elevator and causes the latter to rise again, whereupon the conveyor speeds are restored to their normal value for shingling and handling and the process continues and is repeated. This is primarily a method patent. It requires four sets of conveyors, stops and controls to operate making the latter quite complex and unreliable.

In none of the prior art is any provision made to insure constant and uniform travel of the sheets on the conveyors to prevent their skewing and jamming o otherwise interrupt the smooth operation of the machine because of non-uniform travel of the sheets. My novel control and synchronizing of the flow of sheets through the machine and improved conveyor construction overcomes long standing problems.

SUMMARY OF THE INVENTION

I incorporate a number of novel features in my construction to produce the smooth operation of the machine through better control of the flow of sheets to the downstacking elevator, the flow in my case being continuous at all times throughout the cycle.

In particular I utilize high speed accelerating rollers to feed my sheets from the cut-off knife of the previous processing machine to a flow control conveyor operating at a reduced speed. This is a relatively short conveyor that is constructed to be tilted angularly by means of a hydraulic piston so that the conveyor may be tilted to slow the flow forward as the sheets are fed to it and to assist in the formation of shingled bundles in which the shingling may be as high as 80%, and utilizes a vacuum to assist in holding the sheets on the conveyor. I eliminate the use of a separate accumulating or accumulator conveyor and positive stops and feed the shingled sheets directly onto my main conveyor which is a long inclined conveyor normally operating at the same speed as my feed control conveyor, the former feeding my sheets to the stacking elevator through a pair of pinch rollers, the lower roller being constructed with a friction surface and being motor driven while the upper roller, having a smooth surface and being hydraulically mounted to exert pressure on the stack of sheets as they pass through. The sheets are then fed into the stacking elevator which is of a construction more simplified than those previously used. The downward movement of the elevator which is hydraulically operated, is timed to correspond with the numerical count of sheets as they leave the cut-off knife as is the coordination of the speeds of the conveyors as well as the discharge of the sheet stack and return of the elevator to its initial position after the stack has been discharged.

During the discharge period of my cycle, the reduced speed of my feed control conveyor together with its inclination accumulates and prevents the discharge of sheets to the main conveyor now operating at high speed, while at the same time increasing the shingling of the sheets which continue forward in low motion. At no time do the sheets completely stop in their forward movement.

I have discovered also that much of the difficulty encountered with existing machines may be attributed to the non-uniform rate of the travel of sheets upon the conveyors despite the constant speed of the driving pulleys. By experimentation I have discovered that this fluctuation in speed is due to the non-uniformity of the construction of the conveyor belting in that the construction of most commercial rubber or composition coated fabric or fiber-belting is not uniform in the location of the central fabric with respect to the conveying surfaces. Since the linear travel of the conveyor is governed by the action of the pulley upon the central fiber or tension bearing member of the belt, such variation in construction renders the travel of the surface of the belt non-uniform. In fact, in the distances encountered as represented by the length of some of the longer conveyor belts, the difference in movement of the surface of the belt may vary by several inches from that expected from the linear travel of the surface of the driving pulley.

I have overcome this problem by utilizing what may be called a double layer multiple belting arrangement in which the conveyor comprises a plurality of narrow belts spaced apart uniformly across the pulley over its entire length with a second layer of similar belts overlapping the first layer in the spaces left by the spacing of the latter. Thus, for example, I may use a plurality of belts 6 inches wide for my first layer spacing them 3 inches apart and having my second layer overlap these by 1½ inches on either edge. The lower layer of belts thus becomes a driving belt and the upper layer becomes a carrier belt. In this manner I minimize and practically eliminate the non-uniformity of the travel of the belt insofar as the outer or carrying surface of my double layer construction is concerned.

My construction thus avoids the use of a plurality of conveyors and positive stops thus simplifying the operation and avoiding skewing and jamming of the sheets which occurs with previous constructions. This is accomplished by the continuous and smooth flow of sheets throughout the operation including elimination of fluctuation in speeds of individual sheets while operating at any set velocity.

DESCRIPTION OF A PREFERRED EMBODIMENT

Figure 1:
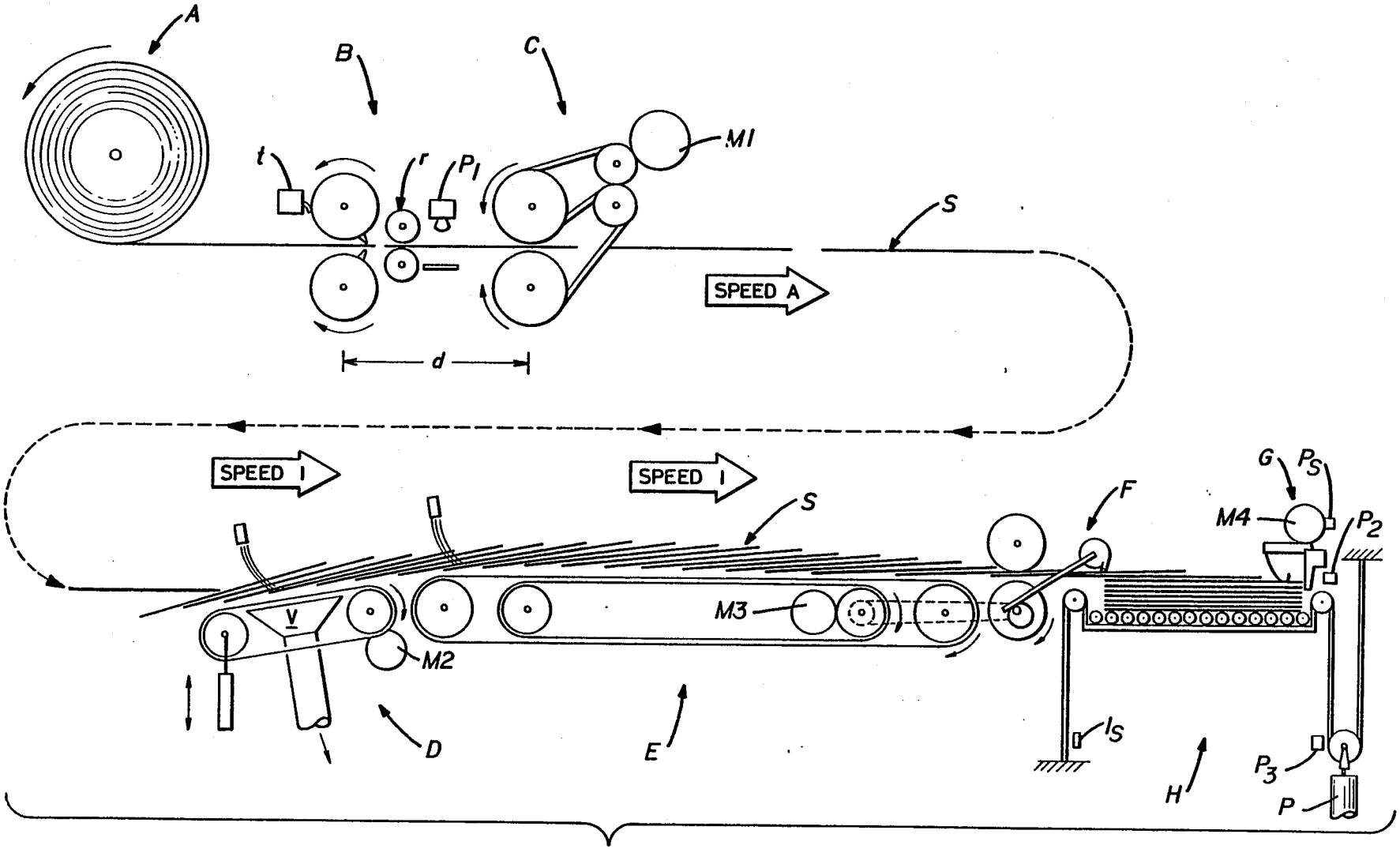
FIG. 1 is a schematic diagram illustrating the relative positions of the component parts of the invention and the general operating system.
Figure 3:
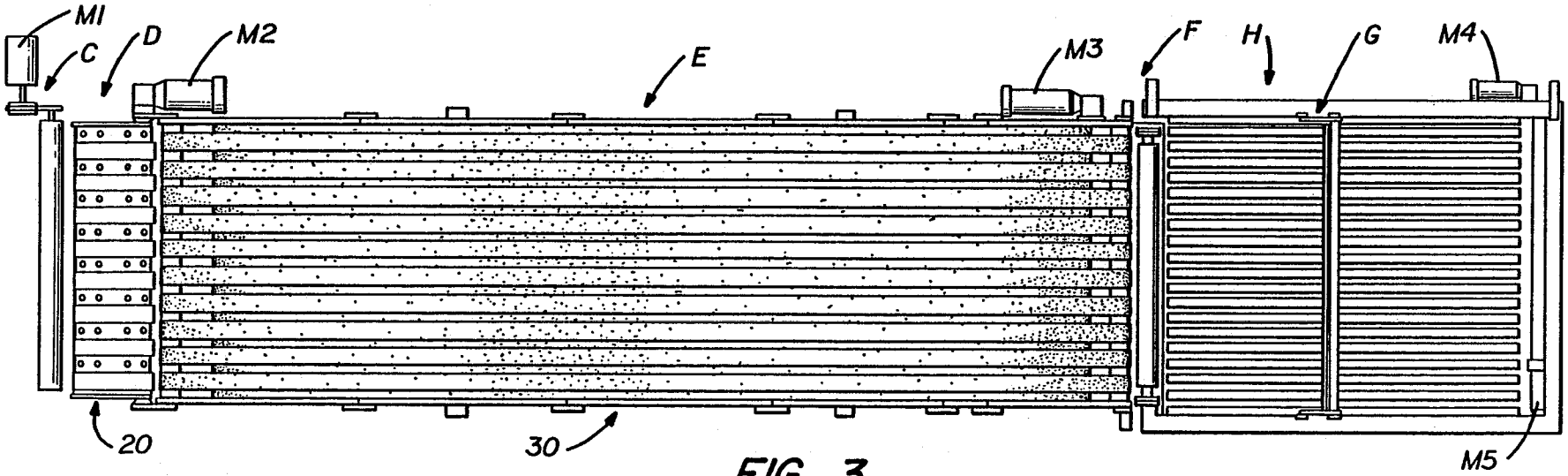
FIG. 3 is a plan view showing the general arrangement of the principal components A through H.
Figure 2:
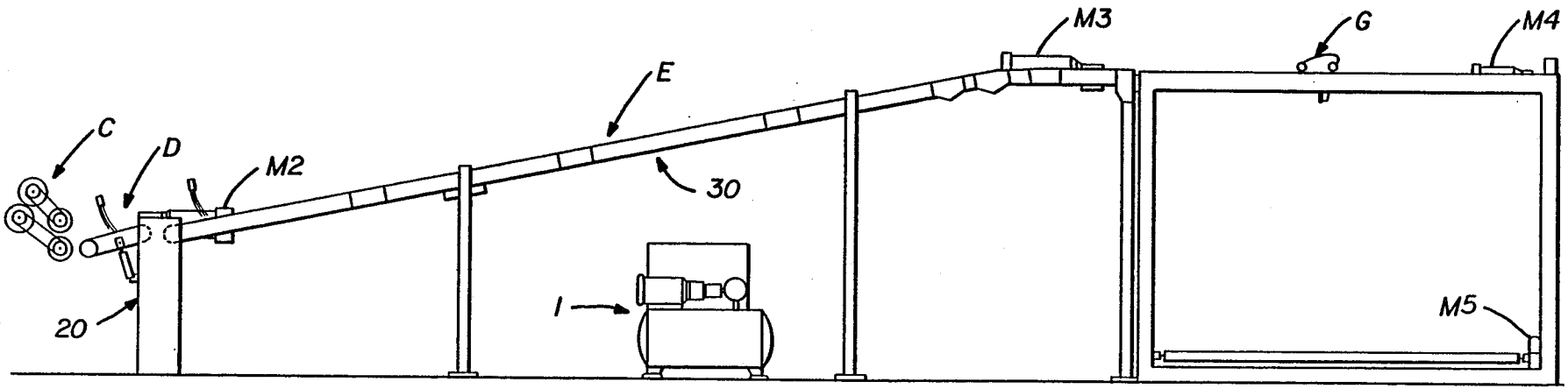
FIG. 2 is an elevation showing the general arrangement of the principal components, A through H.

Reference should first be had to FIG. 1, FIG. 2 and FIG. 3 since these should be read together, FIG. 1 representing a schematic diagram showing the flow of the paperboard sheets through the machine with the relative position of the component parts A through H while FIG. 2 and FIG. 3 show the general structural arrangement and relative position of the principal component parts of the machine. Thus, A represents diagrammatically paperboard being fed from a roll or preliminary processing machine which may be a corrugator to cut-off knife B . This may be any one of a type used in the industry to produce the sheets S whose proper handling is a primary object of this invention. The sheets are fed into an accelerator, component C driven by motor M-1 which operates at a speed greater than that represented by the travel of the sheets through cutter B in order to effect their proper spacing for reasons explained below. This component is more fully described and shown in FIG. 4.

From here the sheets S are fed into component D which is a flow control conveyor. This comprises a plurality of endless belts disposed for tilting in a vertical plane and equipped with a source of vacuum indicated by V to effect the control of the flow of sheets through the machine. It is driven by motor M-2 and is shown and described more fully in FIG. 5 and FIG. 6.

From here the sheets are fed into an incline main feed conveyor component E. This also comprises a plurality of endless belts in overlapping layers for reasons indicated below and as shown and described in more detail at FIG. 6 and FIG. 7. It is driven by motor M-3 which also serves to drive the next component.

This is component F which is a conveyor discharge, nip rollers, and spanker bar . These combine to effect the proper discharge on to elevator H and are more fully shown and described in FIG. 7, FIG. 8 and FIG. 8A. and FIG. 8B.

Component G is an adjustable backstop to assist in stacking of the sheets on the platform of elevator H after leaving component F. It is driven by motor M-4 and is more fully shown and described in FIG. 9, FIG. 10 and FIG. 11.

Component H is an elevator having a platform comprised of power driven conveyor rollers driven by motor M-5. The elevator platform is raised and lowered by means of a hydraulic piston P operating through suitable chains and supplied with hydraulic power from a conventional hydraulic power source I which supplies hydraulic power also to other components as described more fully below. Component H, the elevator, is more fully shown and described in FIG. 10, FIG. 11 and FIG. 12. The above components are mounted and supported as needed from the machine structures shown at 20 and 30 on FIG. 2 and FIG. 3. and also on the drawings as pertinent.

Shown also on FIG. 1 are a number of devices essential to the operation and control of the machine as shown on FIG. 13 and described more fully under the heading of "Operation" below. These are as follows. A counter t located on cut-off knife B counts the number of sheets cut off and used to control the size of the batch delivered to elevator H. Rollers r deliver cut-off sheets to accelerator C. A photoelectric cell p-1 is located between cut-off knife B and accelerator C, the distance d between these two components being less than the length of the shortest sheet to be cut to insure continuity of the count. A second photoelectric cell p-2 located at the top of the travel of the platform of elevator component H controls the downward operation of the elevator as sheets are discharged to it. A third photoelectric cell p-3 located at the base of the travel of the platform of elevator H controls the operation of the power driven rollers of the elevator platform when they are operated to discharge the sheets from the platform. A limit switch 1s, also located at the bottom of the travel of the platform of elevator H, serves to control the movement of the platform. The inter-relation of all of these devices is shown on FIG. 13 and described more fully under the heading of "Operation" below.

Figure 4:
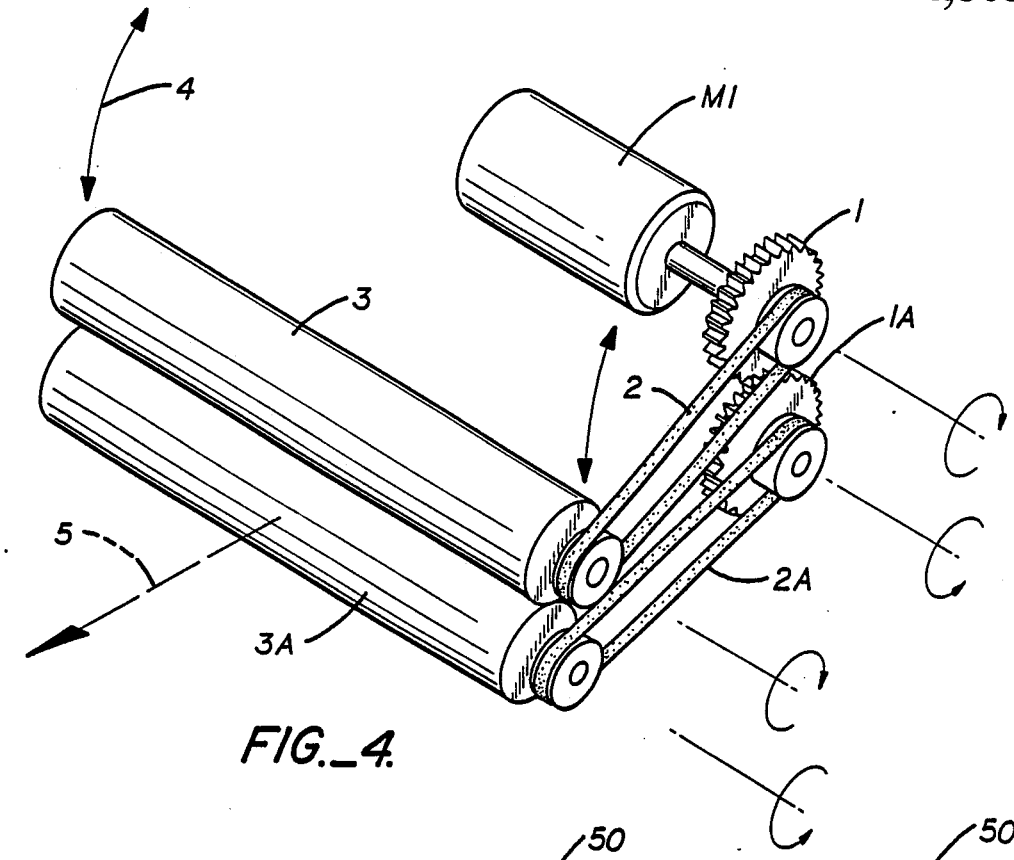
FIG. 4 is an isometric schematic of the accelerator component C.

Referring now to FIG. 4, shown accelerator component C there is seen the driving motor M-1 connected to a pair of spur gears 1 and 1*a* which in turn drive belts 2 and 2*a* and they in turn operate rollers 3 and 3*a*. The function of the spur gears is to maintain positive synchronism between the operation of rollers 3 and 3*a*. Roller 3 is swingable upwards in a direction shown by arrows 4 and the sheets pass between the rollers in the direction shown by arrow 5. The speed of motor M-1 is controlled from a tachometer on cutting knife B (not shown) so as to maintain it at a speed of ten percent above that of the cutting knife B. In this manner effective movement of sheets S from the cutting knife is effected and their proper spacing maintained as they proceed toward flow control conveyor D.

Figure 5:
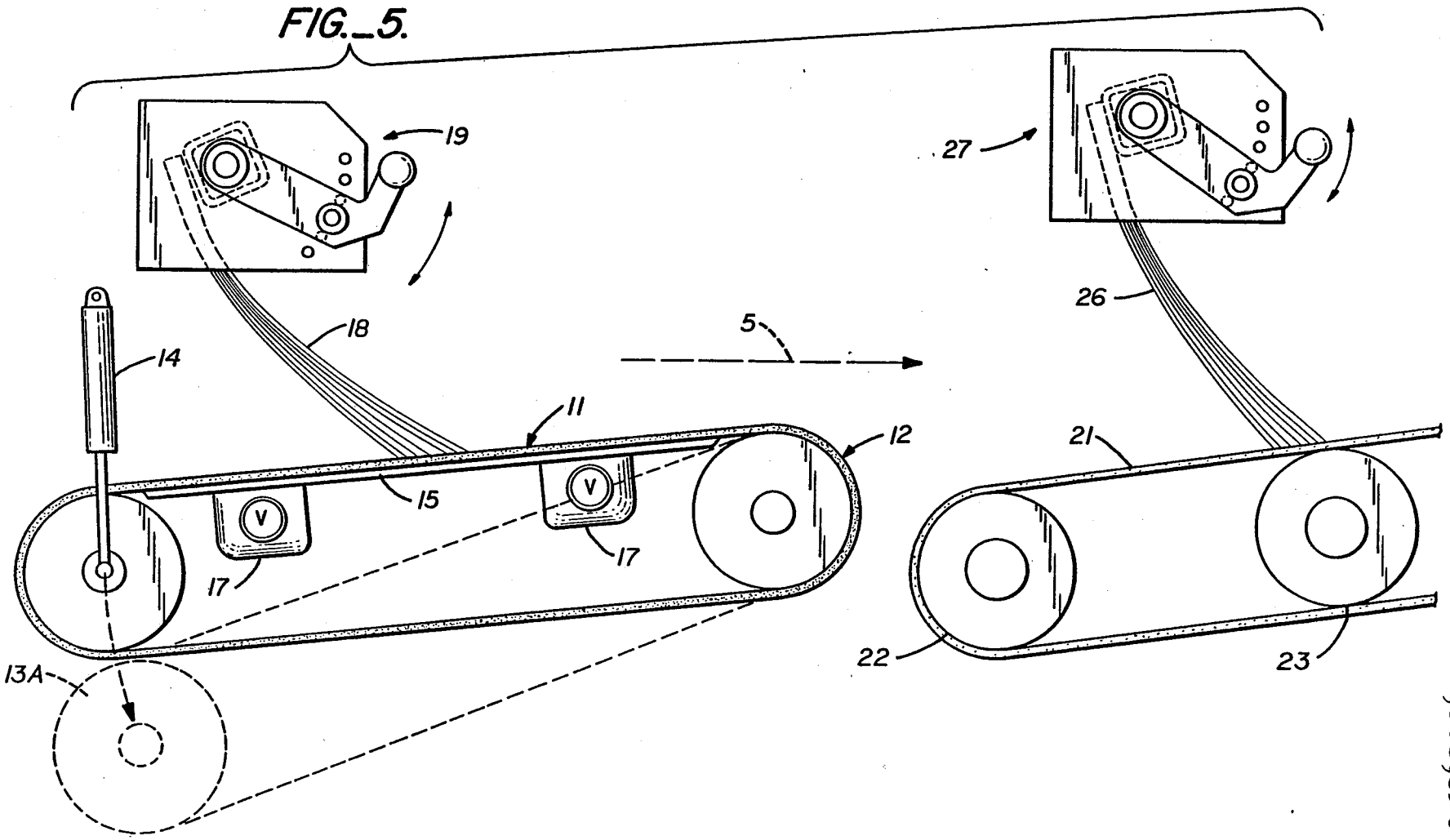
FIG. 5 is an elevation view of the flow control conveyor component D and the tail end of the main conveyor E.
Figure 6:
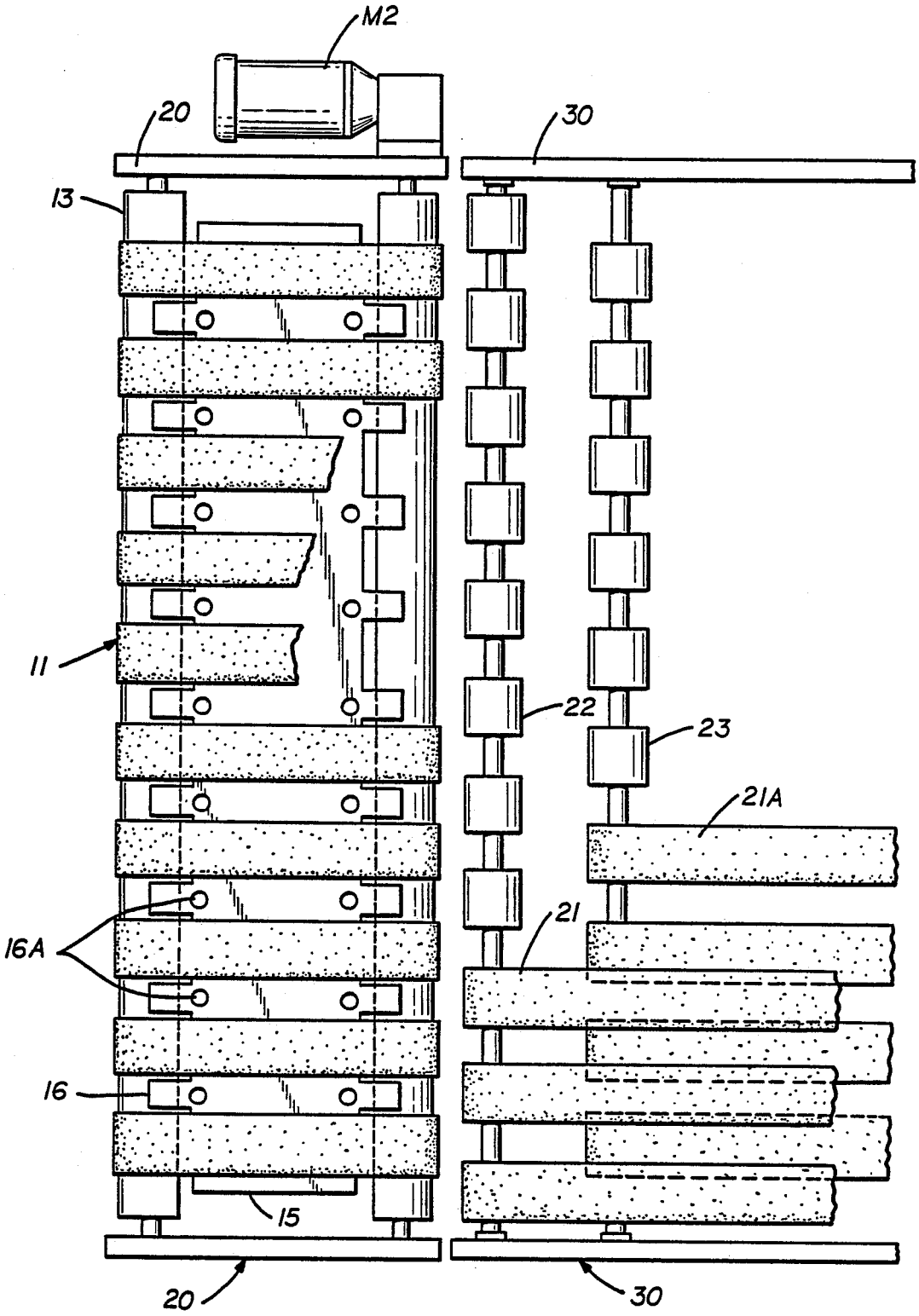
FIG. 6 is a plan view of the flow control conveyor component D and the tail end of the main conveyor E.

Referring now to FIG. 5 and FIG. 6, there is seen the tilting flow control vacuum conveyor component D. First there is seen a plurality of parallel endless belts having friction surfaces 11 riding over driving or head pulley 12 which is stationary in position and tail pulley 13 which is disposed for pivoting around the axis of head pulley 12 in a vertical plane to an angle of 13° as shown in its position 13*a*. The angular movement of this pulley is effected by means of hydraulic plunger 14 which is a part of the hydraulic system supplied by component I shown on FIG. 3.

A support plate 15 is positioned beneath the carrying surfaces of belts 11. This plate is preferably made of a ductile material such as a standard plastic and is equipped with flexible sealing fingers 16 and holes 16*a*. The holes 16*a* connect with a source of vacuum V by means of pipe connection 17. By this means a continuous vacuum from a source not shown is exerted against sheets riding on top of the conveyor belts, the vacuum causing fingers 16 to rise and make contact with the bottom of the traveling sheets, thus tending to seal the vacuum against the sheets and make its action more effective than that obtained by previous vacuum conveyors in use. Hold down brushes 18 which may be of plastic or wire with adjustment 19 are positioned above the conveyor and assist in maintaining the sheets in position while they travel on conveyor belts 11. The machine is driven by motor M-2 and the entire assembly is mounted on the machine structure 20 indicated on FIG. 2 and FIG. 3.

Figure 7:
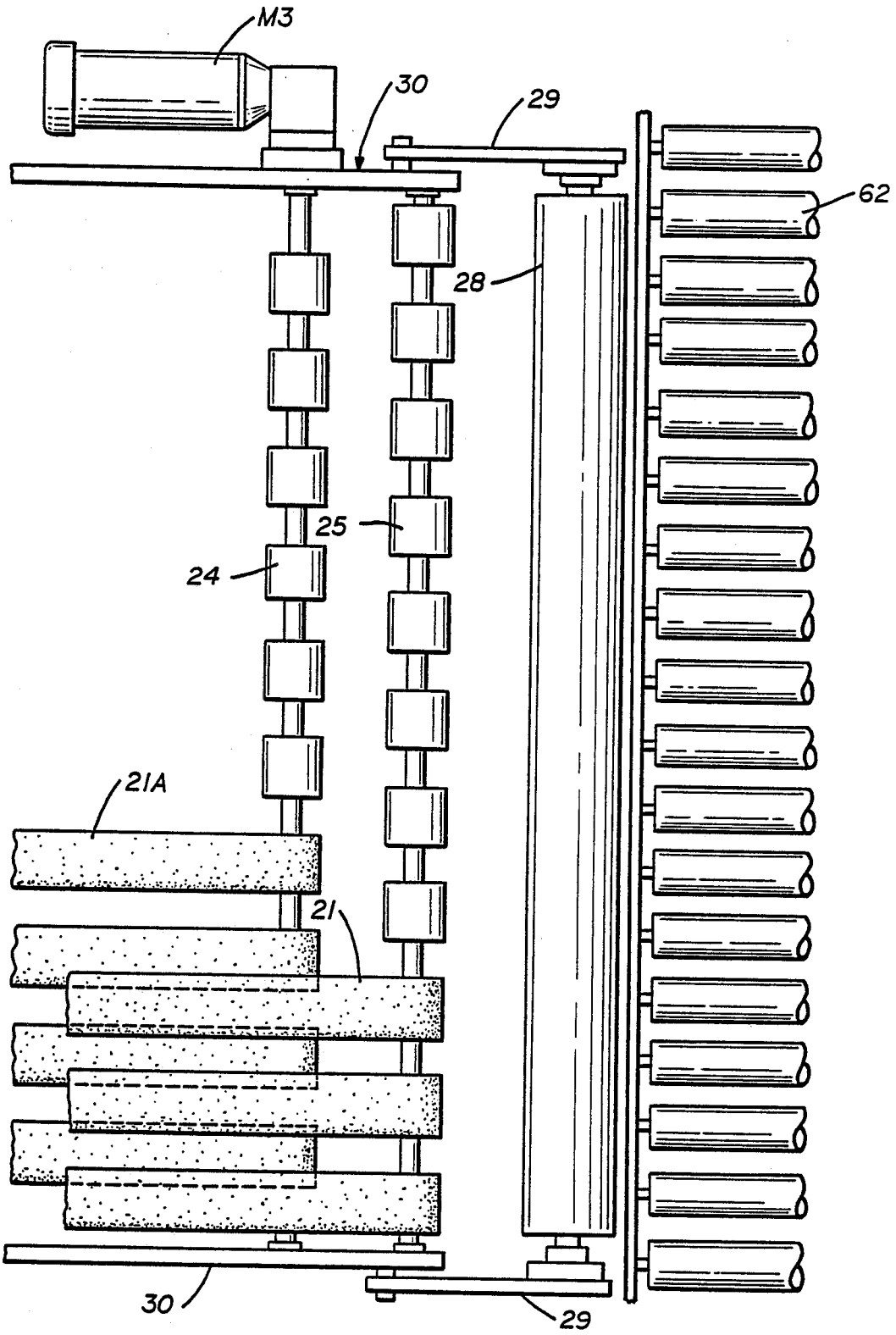
FIG. 7 is a top view of the driven or discharge end of the main conveyor component E.

Reference should now again be had to FIG. 5 as well as FIG. 6 and FIG. 7 in which are shown details of main feed conveyor component E. On this conveyor two sets of a plurality of parallel endless belts are used, one superimposed upon the other. A first set 21 which represents the carrying belts with their friction surface are superimposed upon a second set 21*a*, the long edges of belts 21 overlapping the parallel edges of belts 21*a* by approximately 1½ inches. Belts 21*a* also having friction surfaces represent the driving belts as distinguished from the carrying belts 21 and are driven by motor M-3. Tail pulleys for belts 21 are shown at 22 and for belts 21*a* at 23. These are located on the receiving end of conveyor E. At the discharge end of the conveyor are seen head or driving pulleys 24 for conveyor 21*a* and head pulleys 25 for conveyor 21. This conveyor is likewise equipped with hold down brushes 26 with adjustments 27 located at the receiving end of the conveyor as seen on FIG. 5.

Figure 8:
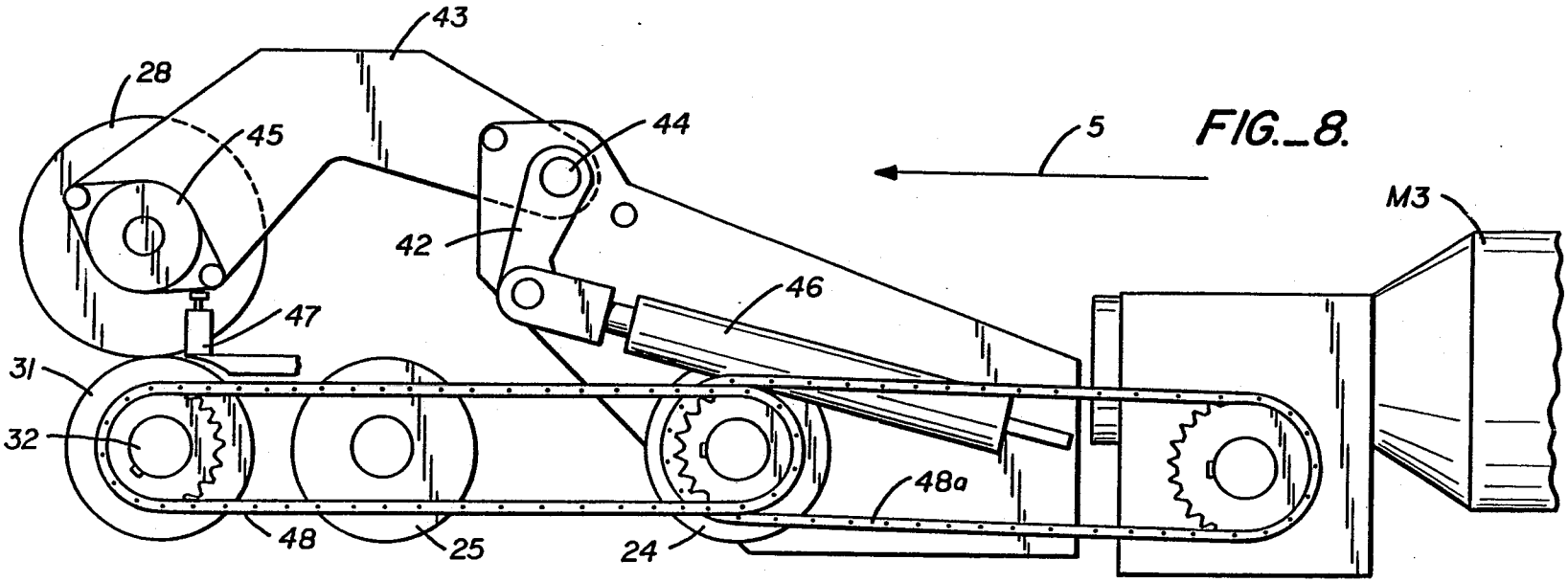
FIG. 8 is a side elevation of the driven or discharge end of the feed conveyor component E showing a portion of component F.

Seen also on FIG. 7 are nip rollers 28 supported on swinging arm shown as 29 and shown and described more fully on FIG. 8. The total assembly is mounted on the conveyor structural frame 30 shown on FIG. 2 and FIG. 3. The nip roller 28 forms a part of component F located between the discharge point of conveyor E and elevator H as described more fully below.

Reference should now be had to FIG. 8 which is a side elevation of the driven or discharge end of the feed conveyor component E showing a portion of component F. Shown here are previously referred to lower belt driving pulleys 24 and upper belt conveying pulleys 25, upper nip roller 28, as well as lower nip roller 31 and driving motor M-3. Mounting plate 41 is supported on conveyor structure 30 and carries lever arm 42 and yoke arm 43, these being keyed together on shaft 44. Bearing 45 is carried by yoke arm 43 and supports top nip roller 28. Nip roller 28 is an idler roller and is thus seen to swing about shaft 44 increasing the gap between the two nip rollers and permitting stacks of sheets of various heights coming from the conveyor to pass through. The rise and fall of nip roller 28 is controlled by shock absorber 46 and adjustable stop 47. Nip roller 31 is driven by means of chain drive 48 from lower conveyor drive pulley 24 which in turn is driven by another chain drive 48*a* from motor M-3 as described previously. This mechanism serves to deliver single sheets or bundles of sheets from the conveyor to the elevator platform which action is augmented by spanker bar mechanism described below.

Figure 8B:
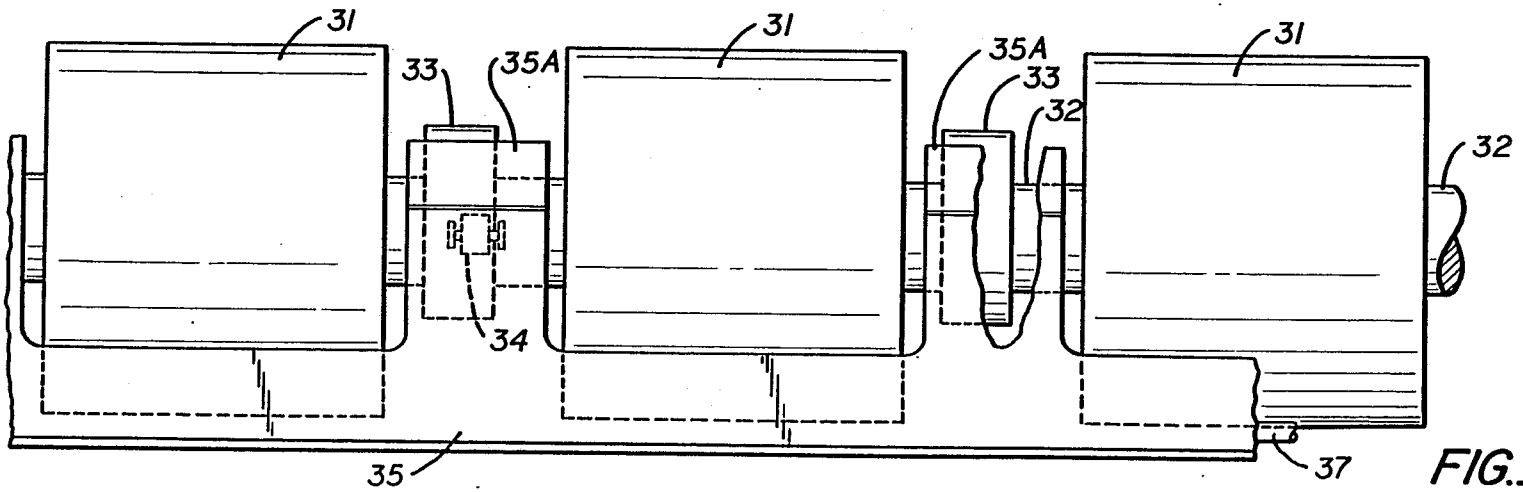
FIG. 8B is front view of the spanker bar mechanism of component F.
Figure 8A:
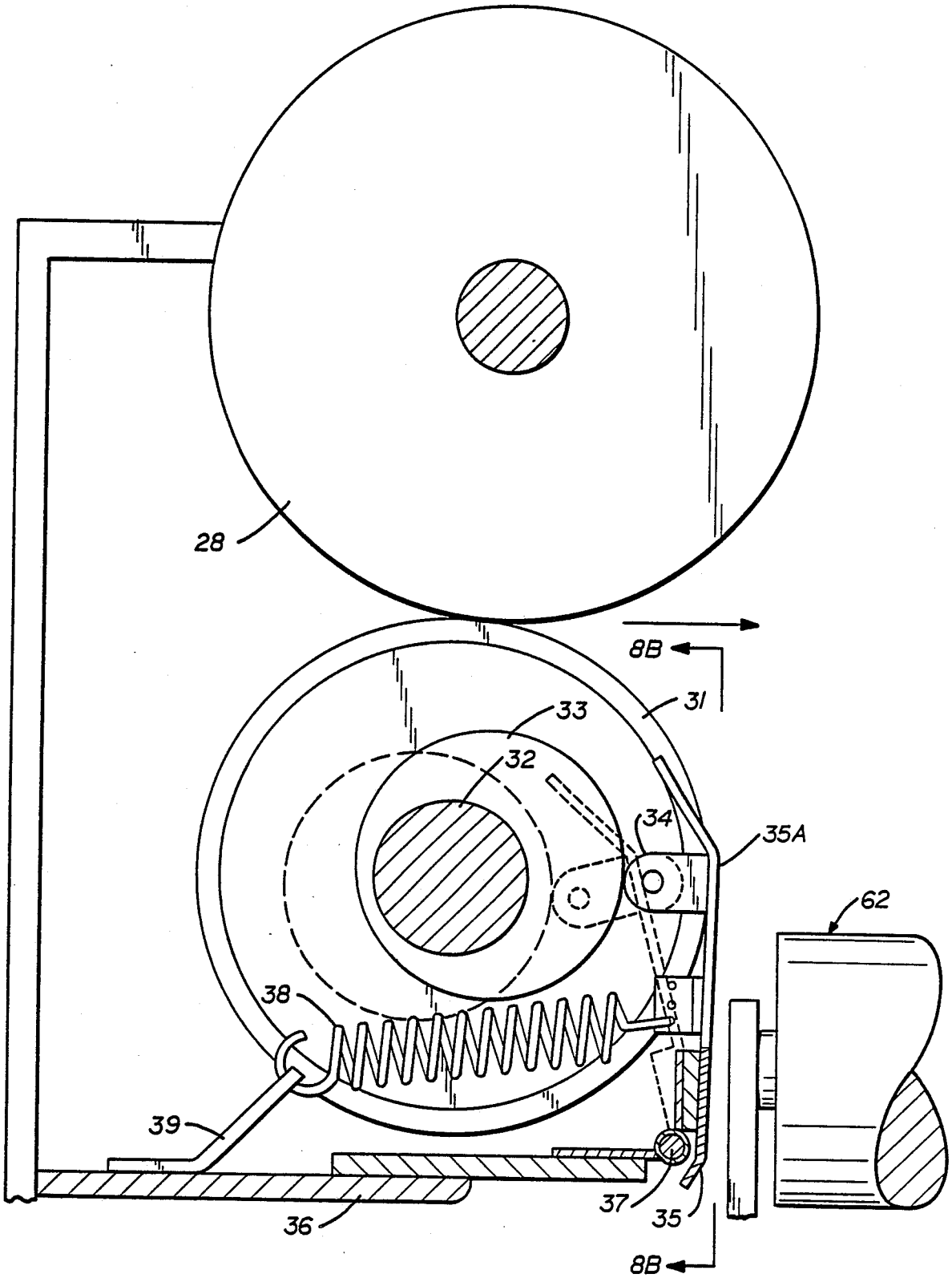
FIG. 8A is a side view of the spanker bar mechanism of component F.

I have found that relying on the inertia of the sheets discharging from nip rollers 28 and 31 in the direction shown by the arrow of FIG. 8A is insufficient to insure proper stacking of the sheets on the elevator platform. A positive means for aligning the sheets to form a neat stack was found necessary. This I accomplish by the paddle or spanker bar mechanism shown and described in FIG. 8A and FIG. 8B which represents a decided improvement over previous practices in the art.

Reference should be had to FIG. 8A and FIG. 8B on which are seen the nip rollers and spanker bar mechanism which form a part of component F of the machine. Here seen are top nip roller 28, previously referred to, and lower nip roller 31 with drive shaft 32. The latter actually comprises a plurality of rollers spaced apart and having friction surfaces. The lower nip roller 31 is driven from lower conveyor drive pulley 24 while the upper nip roller 28 is an idler as more fully shown and described previously in FIG. 8.

Positioned between rollers 31 are a plurality of cams 33 driven by shaft 32 of lower nip rollers 31 and having followers 34. A spanker bar 35 extends across most of the width of the conveyors and incorporates a plurality of fingers 35A. A bracket 36 supports a pivot 37 on which the spanker bar 35 is mounted. Spanker bar 35 oscillates about pivot 37 under the action of cams 33. Spring 38 mounted on bracket 36 by hook 39 urges followers 34 against cams 33.

As sheets pass through the nip rollers 28 and 31, fingers 35A oscillate at a relatively high velocity under the action of cams 33, strike their trailing edges as they are discharged onto elevator platform roller 62, thus effecting their alignment into a neat stack.

Figure 9:
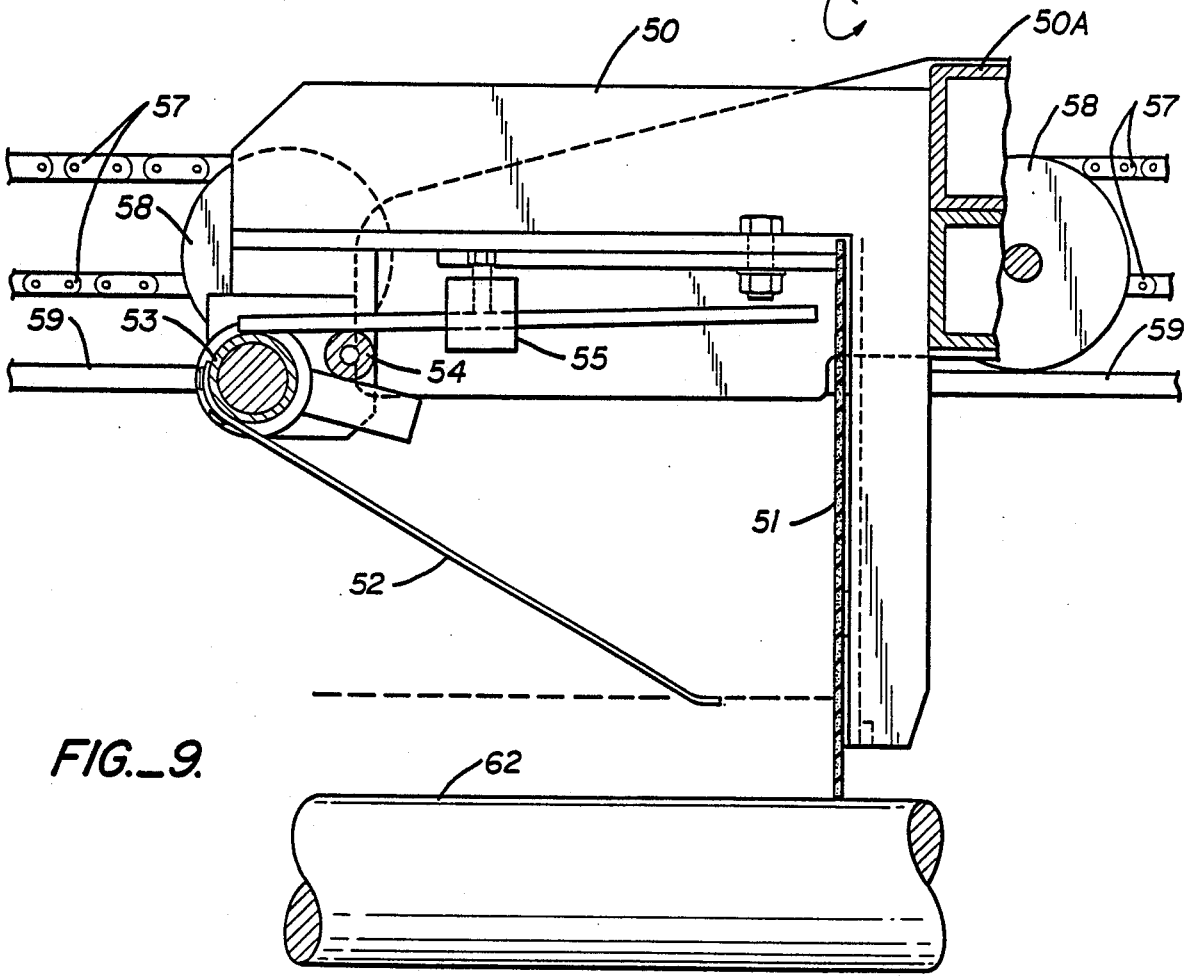
FIG. 9 is an end view of the backstop mechanism of component G.
Figure 10:
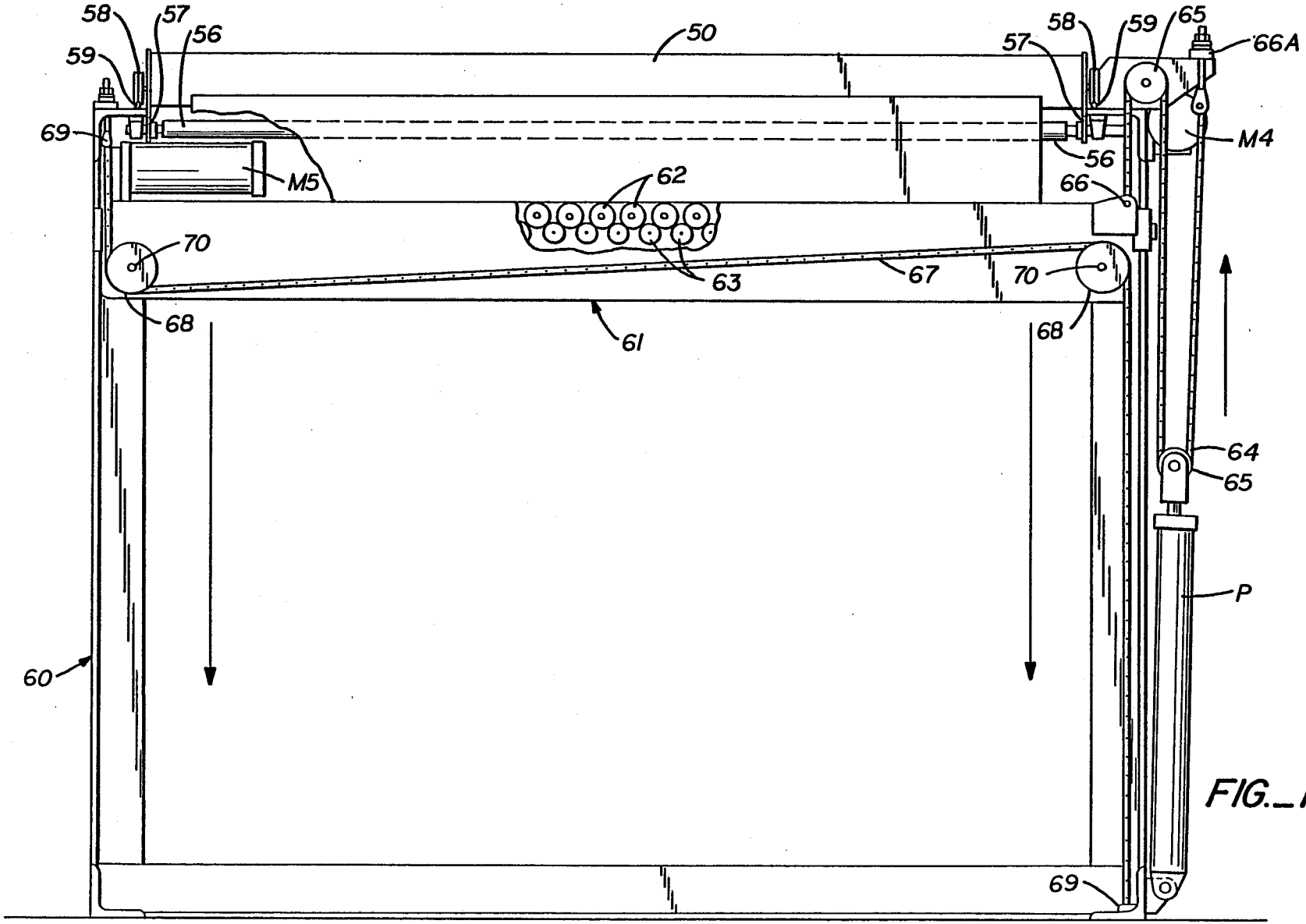
FIG. 10 is an end view of the elevator H.

Reference should now be had to FIG. 9 and FIG. 10 which show the backstop mechanism component G which forms a part of elevator H and serves to assist in forming the stack upon the elevator platform. It is adjustable in position across the elevator platform in direction of travel of the sheets and supported from the platform by support bracket 50 and support arm 50*a*. The stop plate itself, 51 shown carried by the bracket 50 may be made of resilient or elastomeric material to avoid damage to the sheets when they strike the plate. The sheets are guided downwards into a stack by spring hold down members 52 which may be of leaf spring material and are a plurality in number carried by spring holder shaft 53 across the width of the stop plate itself which is somewhat less than the width of the elevator platform. A weight support shaft 54 and counter weight and shaft 55 serve to provide adjustment for hold down members 52.

Figure 11:
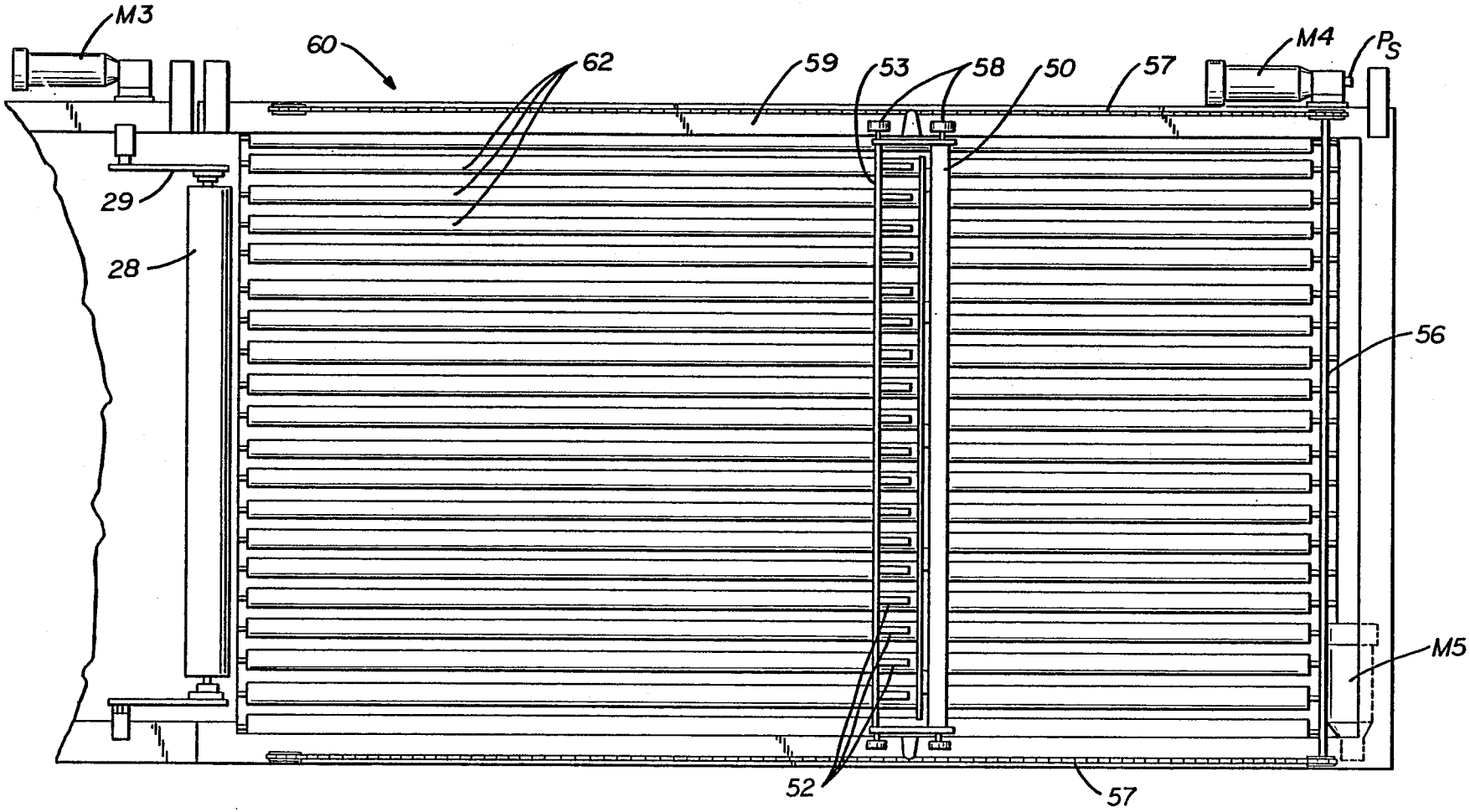
FIG. 11 is a top view of the elevator H.

Provision is made for positioning the backstop as referred to above comprising a drive shaft 56 driven by motor M-4 and engaging sprocket and chain drive 57 which may be seen better on FIG. 11. The backstop support is disposed to ride on V-shaped sheaves 58 riding on circular rail 59 lengthwise of the platform 61 of elevator H. The position of the backstop along the length of the elevator platform may be adjusted from the central control system described below.

Figure 12:
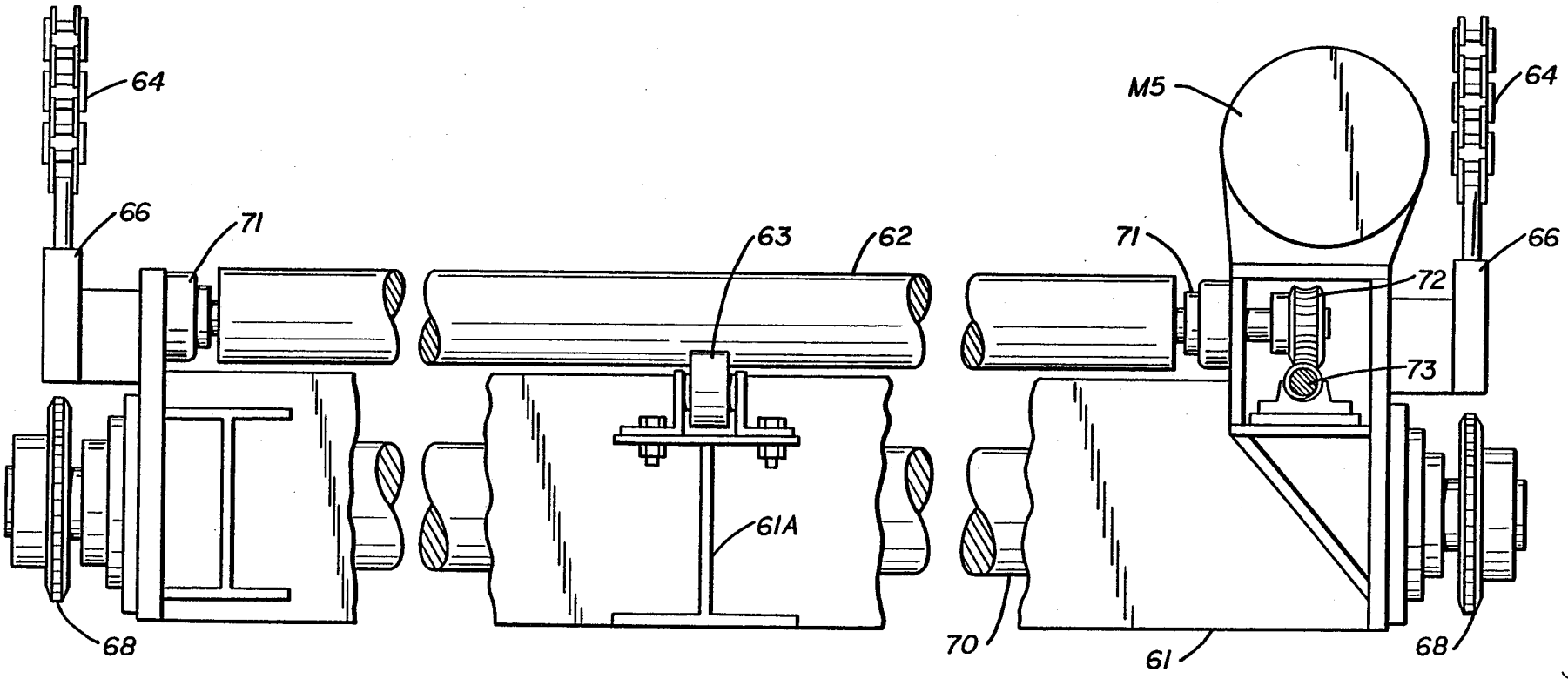
FIG. 12 is a side view of a partial section of the platform and drive of the elevator of FIGS. 10 and 11.

Reference should now be had to FIG. 10, FIG. 11 and FIG. 12 on which are seen various views of the elevator component H which while being termed an elevator in the trade, in effect functions as a lowerator and serves to accumulate a predetermined number of sheets as delivered from the previous components and deliver a stack so formed for further disposition and use.

The elevator comprises a hollow frame structure 60 and a platform 61 which is comprised primarily of a plurality of live or power driven conveyor rollers 62 supported at their mid-points by a plurality of idler rollers 63 by means of platform structure 61*a*. Hydraulic operating cylinders P supplied by hydraulic power source I shown on FIG. 2 serves to operate chains 64 engaging sprockets 65, one end of the chains being positioned on the platform at 66 and the opposite end on the elevator structure at 66*a*.

To insure proper operation of the platform in maintaining it at all times parallel to the horizontal, leveling chain 67 is provided which engages leveling sprockets 68 and is anchored at its opposite ends to the top and bottom of elevator structure 60 respectively at 69. Sprockets 68 rotate about leveling shafts 70 which are rotatably mounted on platform 61.

Live conveyor rollers 62 mentioned above, are mounted on platform 61 by means of bearings 71, each roller having a central shaft and carrying thereon worm wheel 72. Worm shaft 73 runs the entire length of platform 61 and engages each worm wheel in turn. Worm 73 is driven by motor M-5, also carried on platform 61, as indicated schematically on FIG. 2.

Figure 13:
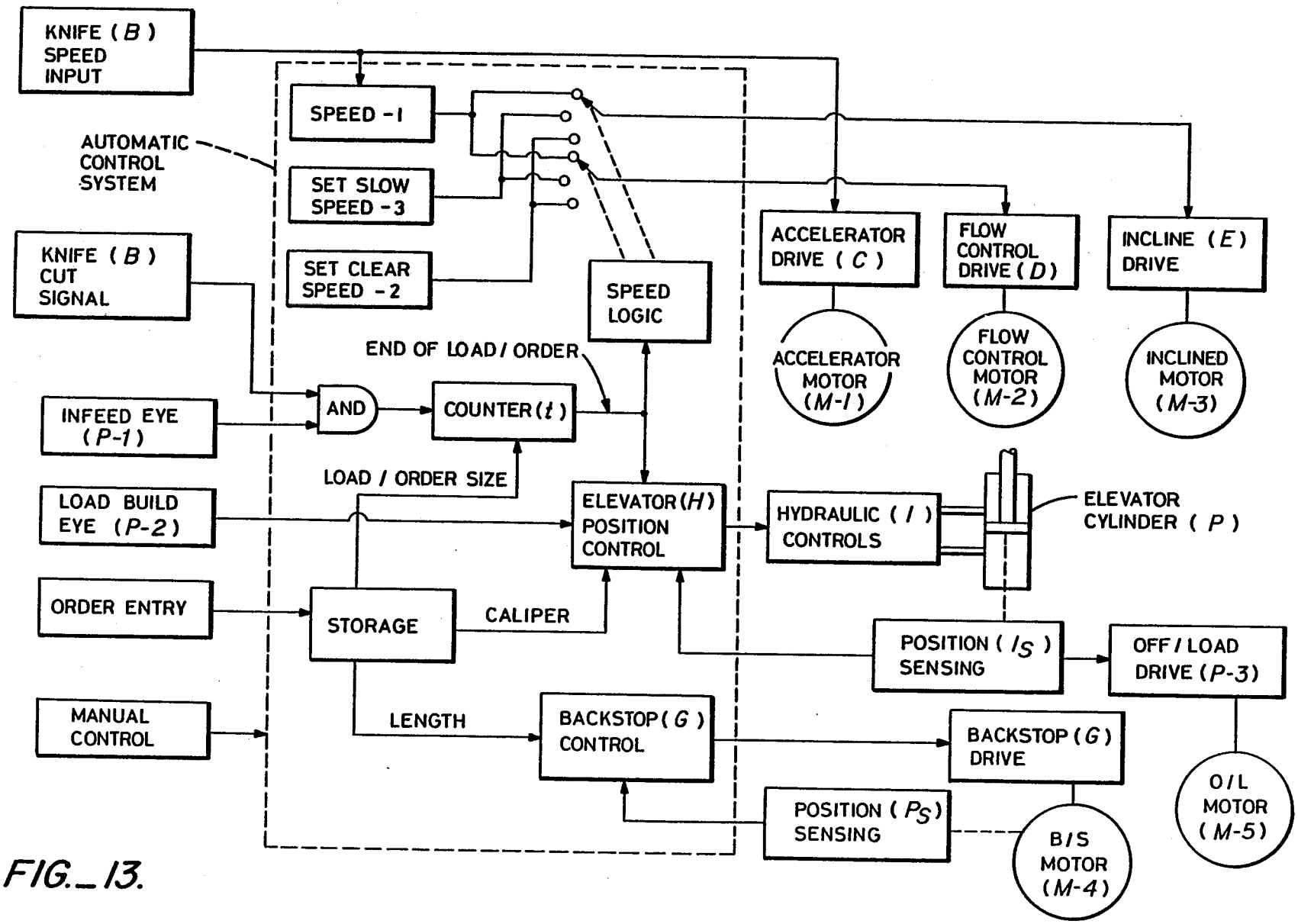
FIG. 13 is a diagram illustrating the system of control of the method of operation of the machine, or logic diagram.

Reference should now be had to FIG. 13 which is a logical diagram illustrating the system of control and the method of operation of the machine. The components and their related control elements are identified by their corresponding letters as described on FIG. 1.

Thus the critical speeds, namely speed A, Speed 1, Speed 2 and Speed 3 for motors M-1, M-2 and M-3 are indicated. Their inter-relationship is explained under "Operation" below. The counter t on knife B controls the height of the stack of sheets on elevator H. This is also governed by what is shown as the order entry to storage of the caliper or thickness of the sheets and their length. The latter controls the position of backstop G which is governed by position sensing device ps which may be a pulse generator. Elevator position control through the hydraulic controls and elevator cylinder P is effected by load build eye p-2. Sheets piling up on platform of elevator H intercept p-2 which continues platform in descent until it strikes position sensing device or limit switch 1s which also starts off load drive motor M-5 which continues until interrupted by p-3. All of the foregoing is explained more fully under "Operation" below.

OPERATION

Figure 1A:
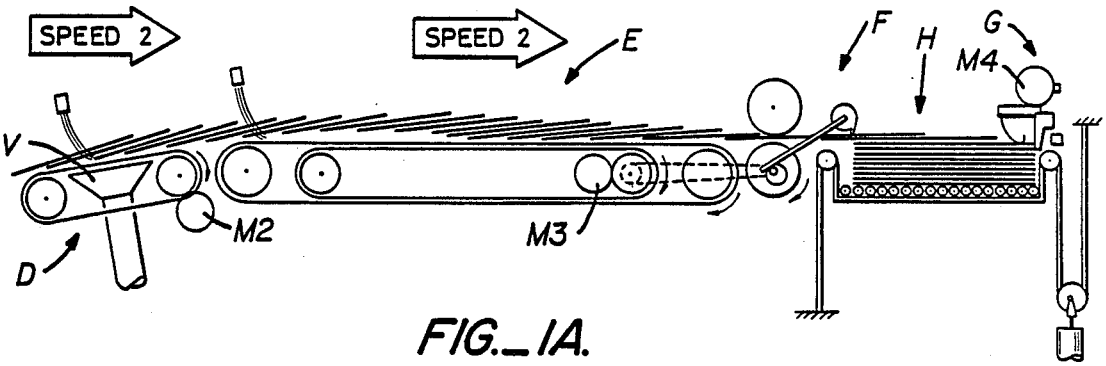
FIGS. 1A through 1D illustrate successive steps in the operation of the invention.
Figure 1B:
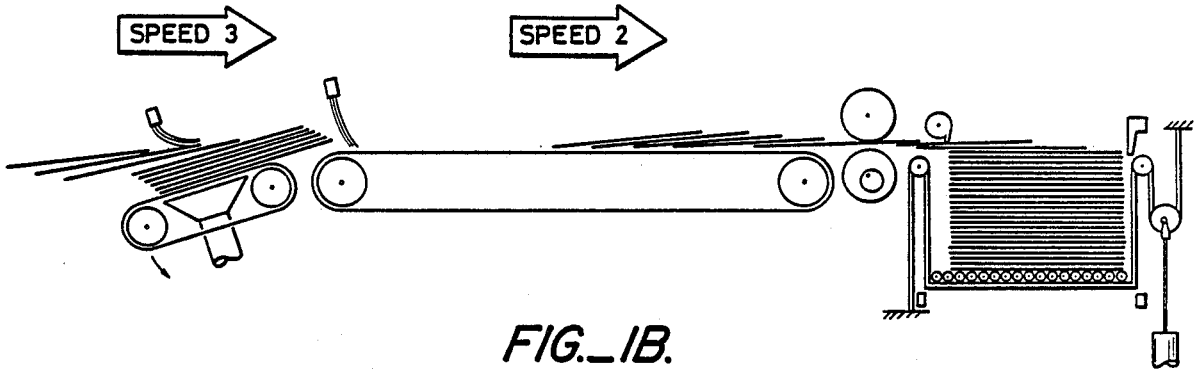
Figure 1C:
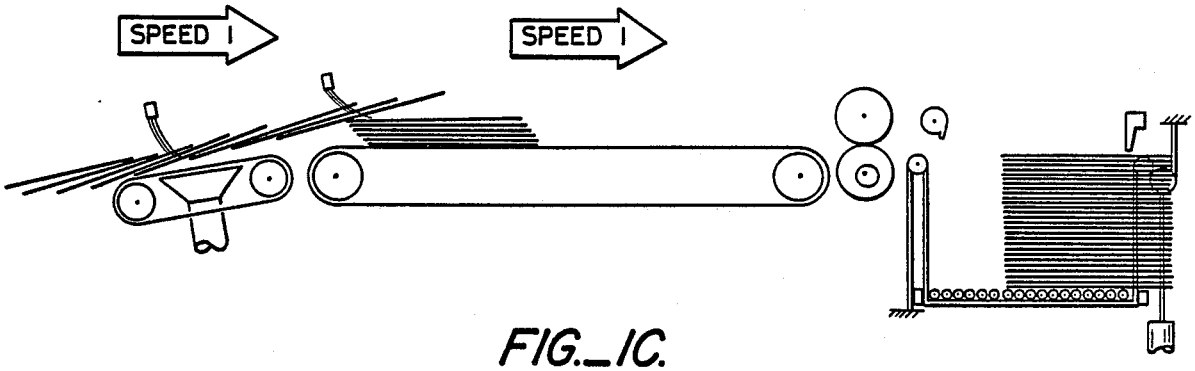
Figure 1D:
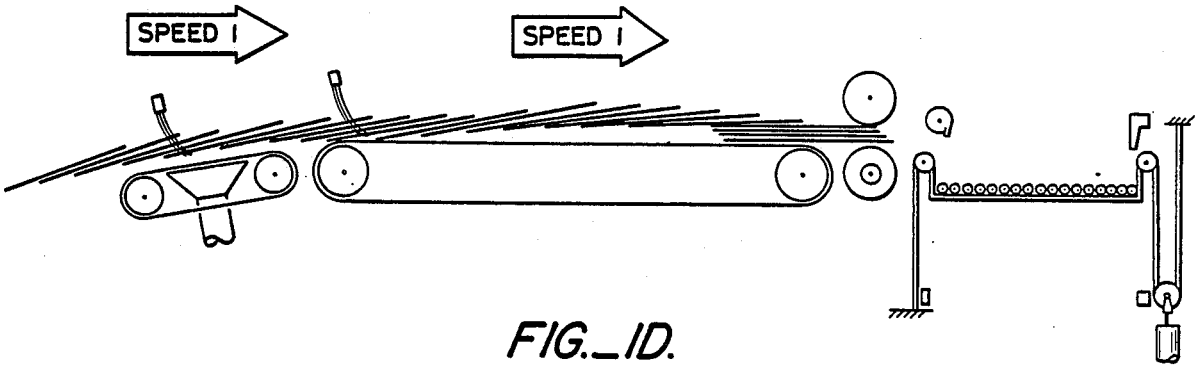

Reference should now be had to the drawings - FIG. 1 through FIG. 1D to understand the method of operation of the invention and to FIG. 13 for the control.

Step 1 (FIG. 1.) At the start of the operating cycle the number and thickness of sheets S desired is fed into the central computerized control shown on FIG. 13. The speed of corrugator A which is equipped with a tachometer is synchronized with the speed of knife B also equipped with a tachometer and controls the rate of output of the machine. The "SPEED A" of the accelerator C is automatically adjusted to be ten percent above the speed of knife B for proper handling of the sheets at this point. The "SPEED 1" of flow control conveyor D and main feed conveyor E at this time are set at twenty percent of the knife speed (usually in the range of 50 to 170 feet per minute) which provides for up to eighty percent overlapping or shingling. The roller platform of elevator H at this time is close to the top of its travel at which point is located photoelectric cell p2. The elevator platform starts to descend continuously under control of photoelectric cell p2 as it is intercepted by sheets stacking up on the elevator.

Step 2. (FIG. 1A) When the number of sheets cut by knife B reaches a predetermined number as determined by knife counter t on knife B, conveyors D and E shift to a high "SPEED 2" (about 450 feet per minute) for a few seconds or until conveyor D is cleared.

Step 3. (FIG. 1B) As soon as a conveyor D is cleared, its back end is tilted downward and at the same time it slows down to a "SPEED 3" (approximately 17 feet per minute) which interrupts the flow of sheets to conveyor E and the sheets then accumulate while moving slowly forward on conveyor D. Conveyor E continues at "SPEED 2" and elevator platform continues downward.

Step 4. (FIG. 1C) When elevator platform strikes limit switch 1s (stack has usually attained the height of approximately 72 inches at this point), it starts the elevator platform rollers rotating at high speed to discharge the stack of sheets. At the same time conveyor D tilts back up again discharging its accumulated sheets upon conveyor E and both conveyors resume "SPEED 1". Elevator rollers continue discharging for a set time and until the sheets clear the photoelectric cell p3.

Step 5. (FIG. 1D) Elevator returns to the initial position it occupied at start of FIG. 1 while conveyors D and E continue to operate at "SPEED 1". Sheets S including the accumulated sheets from conveyor D advance along conveyor E and then start discharging on the elevator to start step 1 again.

It is thus seen how only two conveyors are employed in this method and no positive stops of any kind are needed to impede the movement of the sheets, thus being more simple and avoiding many of the problems inherent in other methods and systems of handling sheets for purposes of stacking.

I claim:

1. A machine for handling sheets on conveyors to form a stack thereof comprising:

a first tiltably mounted flow control conveyor disposed to receive sheets from the discharge of a cutting knife of a sheet processing machine and to discharge said sheets onto, a second inclined belt conveyor positioned to receive said sheets from said first flow control conveyor and to discharge said sheets to, a pair of rotating pinch rollers positioned to grip said sheets therebetween and to discharge said sheets onto, a platform of a vertical elevator positioned against said rollers and disposed to receive said sheets successively from said rollers while descending from an initial elevated position opposite the discharge of said rollers to form a stack upon said platform;

said first flow control conveyor being further equipped with a vacuum source positioned beneath its carrying surface to effect retention of sheets thereon;

separate driving means for said first conveyor and said second conveyor;

speed control means disposed for operating said driving means of both of said conveyors initially at a first speed lower than the linear velocity of said sheets discharging from said processing machine thereby causing overlapping of said sheets on said conveyor;

said speed control means being disposed for increasing the speed of both of said conveyors to a second relatively high speed for a short interval of time after a predetermined number of sheets has been discharged from said processing machine;

said speed control means being further disposed for decreasing the speed of said first control conveyor to a third relatively slow speed said tilting control means being disposed for simultaneously positioning said first conveyor to said second vertical angle thereby interrupting the discharge of said sheets onto said second conveyor and slowing the forward movement of said sheets on said first flow control conveyor thus causing them to accumulate thereon while continuing the operation of said second conveyor at said second relatively high speed; tilting control means for positioning said first flow control conveyor alternately from a first vertical angle to a second increased vertical angle;

said speed control means being still further disposed for continuing the operation of said second conveyor at said relatively high speed until said predetermined number of sheets has been discharged onto said descending platform thereby completing said stack thereon;

means for arresting the descent of said elevator platform and means for discharging said stack therefrom said speed control means being disposed for simultaneously changing the speeds of both of said conveyors back to the said first speed said tilting control means being further disposed for positioning said flow control conveyor back to said first vertical angle;

means for returning said elevator platform back to said initial position.

2. The machine of claim 1 in which:

said first lower speed in twenty percent of the linear velocity of said sheets discharging from said processing machine;

said second relatively high speed of said conveyors is approximately 450 feet per minute;

said third relatively low speed of said flow control conveyor is 17 feet per minute;

said first vertical angle of said flow control conveyor is approximately 35 minutes to the horizontal;

said second vertical angle of said flow control conveyor is approximately 13° to the horizontal.

3. The machine of claim 1 including means for discharging said stack from said platform comprising:

a plurality of rollers positioned on said platform;

means for controlling descent of said platform continuously from said initial elevated position;

means for rotating said rollers at a relatively high speed when said platform reaches a predetermined point;

means for stopping rotation of said rollers after a predetermined interval;

means for returning said platform to said initial position.

4. The machine of claim 1 in which said first tiltably mounted flow control conveyor comprises:

a plurality of narrow endless belts in parallel spaced relation across the faces of a pair of pulleys defining transverse gaps therebetween;

a single support plate of thin flexible material positioned transversely underneath the carrying surfaces of said belts and extending across said conveyor;

parallel longitudinal edges of said plate defining a plurality of flexible fingers positioned in said transverse gaps;

a plurality of holes in said plate positioned in said gaps;

said holes disposed to communicate with said source of vacuum;

whereby said vacuum source causes said fingers to make contact with the underside of said sheets, thereby increasing the holding power of said conveyor on said sheets.

5. The machine of claim 1 including means for stopping the motion of said sheets as they are discharged from said second conveyor onto said elevator platform comprising:

a vertical stop plate positioned by means of a movable bracket on the structure of said vertical elevator above said platform;

means for moving the position of said bracket and said stop horizontally across the top of said platform responsive to a central control;

spring means positioned on said bracket disposed to guide said sheets ownward as they are discharged from said second conveyor.

* * * * *